US006945080B2

(12) United States Patent
Maeda et al.

(10) Patent No.: US 6,945,080 B2
(45) Date of Patent: Sep. 20, 2005

(54) KNITTED GLOVE

(75) Inventors: Hiroshi Maeda, Wakayama (JP); Tateo Maehara, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 236 days.

(21) Appl. No.: 10/451,959

(22) PCT Filed: Dec. 21, 2001

(86) PCT No.: PCT/JP01/11306

§ 371 (c)(1),
(2), (4) Date: Jun. 27, 2003

(87) PCT Pub. No.: WO02/052966

PCT Pub. Date: Jul. 11, 2002

(65) Prior Publication Data

US 2004/0055070 A1 Mar. 25, 2004

(30) Foreign Application Priority Data

Dec. 27, 2000 (JP) ..... 2000-399079

(51) Int. Cl.[7] ..... D04B 7/34
(52) U.S. Cl. ..... 66/65; 66/174; 2/169
(58) Field of Search ..... 66/169 R, 170, 66/171, 174, 64, 65, 69; 2/159, 169

(56) References Cited

U.S. PATENT DOCUMENTS

| | | | | |
|---|---|---|---|---|
| 3,788,103 A | * | 1/1974 | Asai | 66/65 |
| 5,239,846 A | * | 8/1993 | Kitaura et al. | 66/174 |
| 5,444,995 A | * | 8/1995 | Benetton | 66/64 |
| 6,216,494 B1 | * | 4/2001 | Essig et al. | 66/65 |

FOREIGN PATENT DOCUMENTS

| | | |
|---|---|---|
| JP | 38-8926 Y | 9/1963 |
| JP | 46-9474 A | 4/1971 |
| JP | 39-10072 A | 4/1971 |
| JP | 61-32420 A | 7/1986 |
| JP | 2000-220064 X Y | 8/2000 |
| JP | 3075442 A | 11/2000 |

* cited by examiner

*Primary Examiner*—Danny Worrell
(74) *Attorney, Agent, or Firm*—Rothwell, Figg, Ernst & Manbeck, P.C.

(57) ABSTRACT

A knitted glove (1) having at least one finger crotch (A, B, C, D) and knitted from a fingertip toward a palm by using a flat knitting machine. With at least one empty needle (J, j) arranged between the knitting needles for use in knitting one of two adjacent fingers confronting each other across the finger crotch therebetween into a tubular form and the knitting needles for use in knitting the other of the two adjacent fingers confronting each other across the finger crotch therebetween into a tubular form, one for each needle bed, a knitting yarn is fed to the knitting needles for use in knitting the one finger, to knit the one finger into a tubular form and then is fed to the knitting needles for use in knitting the other finger, to knit the other finger into a tubular form and, thereafter, the knitting yarn is fed to the knitting needles adjacent to the finger crotch and to the empty needles arranged between the two adjacent fingers, out of the knitting needles on the front and back needle beds for knitting the respective fingers, to form stitches at those needles, whereby the two adjacent fingers at the at least one finger crotch (A) are closed at ends thereof on the side on which they confront each other and also are gored. This produces a knitted glove having the crotches of high-fittedness and less-strained when wearing.

7 Claims, 8 Drawing Sheets

KNITTED GLOVE

TECHNICAL FIELD

The present invention relates to a knitted glove having finger crotches of high fittedness when wearing knitted by a flat knitting machine such as a glove knitting machine.

BACKGROUND ART

Gloves are knitted by using a small knitting machine such as a glove knitting machine. Usually, the glove is knitted starting from a fifth finger and then the other fingers are knitted in the order of fourth finger, third finger, and second finger. Then, the part from the fifth finger to the second finger is knitted as a single tubular body to form a four-finger body. After the knitting of the four-finger body, a thumb is knitted. Sequentially, the thumb and the previously knitted four-finger body are knitted together to form a five-finger body and, thereafter, a wrist is knitted, with which the knitting of the glove is ended.

The glove knitting machine is equipped with a holding bar, which is called a stitch holder, to provide a crotch overlap knitting for a fork of fingers (crotch), so as to prevent the crotch from being holed. The stitch holder is operated to hold two or three stitches of the stitches in the previously knitted finger at its part proximately of a finger to be knitted next, so as to put them into the state of being held in a knitting needle. The knitting needle holding those stitches is used for knitting the next finger. The stitch holder is shifted in order from the fifth finger to the second finger to perform this operation on a finger-by-finger basis. Then, after the knitting of the second finger, the four-finger body is knitted by feeding the knitting yarn round, during which the crotch stitches formed in the respective crotches are overlapped with each other. This knitting is performed for the crotch between the four-finger body and the thumb as well. The crotches of the glove thus knitted are given no holes and also are strengthened.

However, when the knitting of the four fingers from the fifth finger to the second finger and the knitting of the four-finger body are performed in the manner mentioned above, the glove 15 comes to have the crotches in a line P, as shown in FIG. 8. In one's real fingers, the crotch between the fifth finger and the fourth finger is positioned below the crotch between the fourth finger and the third finger and the crotch between the third finger and the second finger. Accordingly, the glove knitted in the manner as mentioned above has the disadvantage that when wearing, the glove does not fit closely to one's real fingers deep in the crotch between the fifth finger and the fourth finger.

In consideration of this disadvantage, the applicant previously proposed a knitting method in Japanese Patent Publication No. Sho 61(1986)-32420. According to this knitting method, the four fingers are knitted in the order starting from the fifth finger, by providing the crotch overlap knitting for all crotches but the crotch between the fifth finger and the fourth finger. Then, after the knitting of the fourth finger, third finger and second finger, the knitting of the three-finger body is performed. While the three-finger body is knitted, the fifth finger and the three-finger body are overlapped in the crotch therebetween by feeding a knitting yarn to the front and back knitting needles holding the stitches of the three-finger body at an end thereof adjacent to the crotch of the fifth finger. Then, the four-finger body thus formed and the thumb are knitted, followed by the knitting of the five-finger body. In this knitting method, since the fifth finger is overlapped with the three-finger body during the knitting of the three-finger body, the crotch between the fifth finger and the fourth finger can be positioned below the other crotches. Further, since the three-finer body and the fifth finger are overlapped by feeding the knitting yarn to the knitting needles holding the stitches of the three-finger body at the end thereof immediately adjacent to the crotch of the fifth finger, they are closely knitted without any undesirable holes, despite of no crotch overlap knitting being provided for the crotch.

However, in the glove knitted in the manner mentioned above, since the stitches of the fifth finger and the fourth finger at the ends thereof on the side on which they confront each other are overlapped with each other in the crotch, the overlapped part is strained when wearing, so that the fifth finger is drawn toward the three-finger body and the depressed crotch between the fifth finger and the fourth finger is raised up. Also, in the conventional knitted glove, since the crotch between the thumb and the second finger, or rather the crotch between the thumb and the four-finger body, is knitted in the crotch overlap knitting, the overlapped part is strained when wearing for the same reason, so that when wearing the glove, a wearer feels uncomfortable tightness at his/her thumb.

It is the object of the present invention to provide a knitted glove having crotches of high-fittedness and less-strained when wearing.

DISCLOSURE OF THE INVENTION

The present invention provides a knitted glove having at least one finger crotch and knitted from a fingertip toward a palm by using a flat knitting maching having front and back needle beds mounting a number of knitting needles thereon and arranged to be opposite to each other, wherein with at least one empty needle arranged between the knitting needles for use in knitting one of two adjacent fingers confronting each other across the finger crotch therebetween into a tubular form and the knitting needles for use in knitting the other of the two adjacent fingers confronting each other across the finger crotch therebetween into a tubular form, at least one for each needle bed, a knitting yarn is fed to the knitting needles for use in knitting the one finger, to knit the one finger into a tubular form and then is fed to the knitting needles for use in knitting the other finger, to knit the other finger into a tubular form and, thereafter, the knitting yarn is fed to the knitting needles adjacent to the finger crotch and to the empty needles arranged between the two adjacent fingers, out of the knitting needles on the front and back needle beds for knitting the respective fingers, to form stiches at those needles in the following steps, whereby the two adjacent fingers at the at least one finger crotch are closed at ends thereof on the side on which they confront each other and also are gored.

a. the step of shifting a yarn feeder toward the finger crotch to feed the knitting yarn to the knitting needles for use in knitting the one finger mounted or one of the front and back needle beds, to form knitted loops of the one finger;

b. the step of reversing a traveling direction of the yarn feeder at the finger crotch;

c. the step of shifting the yarn feeder toward the finger crotch again, to feed the yarn to the empty needles arranged between the knitting needles on the front and back needle beds holding loops of the one finger at a side end thereof and the other finger and to the knitting needles on the front and back needle beds holding loops of the other finger at a side end thereof, so as to put the knitting needles holding the loops of the fingers at the side ends thereof into a state in which the knitting yarn is drawn in to a reduced extent to prevent an old loop held on the needle from being knocked over, and put the empty needles into a yarn hooking state; and d. the step of reversing the traveling direction of the yarn feeder to feed the yarn to the knitting needles of the other needle bed for knitting the one finger, so as to form the knitted loops of the one finger.

The knitted glove is knitted starting from a fifth finger and then is knitted in the order of fourth finger, third finger, and second finger, to knit the four fingers and, thereafter, a four-finger body is knitted and then a thumb is knitted, followed by the knitting of a five-finger body, said knitting for the crotch being provided for the finger crotch between the fifth finger and the fourth finger.

The knitting of a three-finger body may be inserted before the knitting of the four-finger body.

The knitting of the finger crotch may be performed before the knitting of the three-finger body.

The knitting of the finger crotch may be performed after the knitting of the three-finger body.

The knitted glove is knitted starting from a fifth finger and then is knitted in the order of fourth finger, third finger, and second finger to knit the four fingers and, thereafter, a four-finger body is knitted and then the thumb is knitted, followed by the knitting of a five finger body, said knitting for the crotch being provided for the finger crotch between the thumb and the four finger body.

The knitted glove may be a mitten wherein said knitting for the crotch is provided for the finger crotch between the thumb and the four-finger body

BEST MODE FOR CARRYING OUT THE INVENTION

Figure 1:
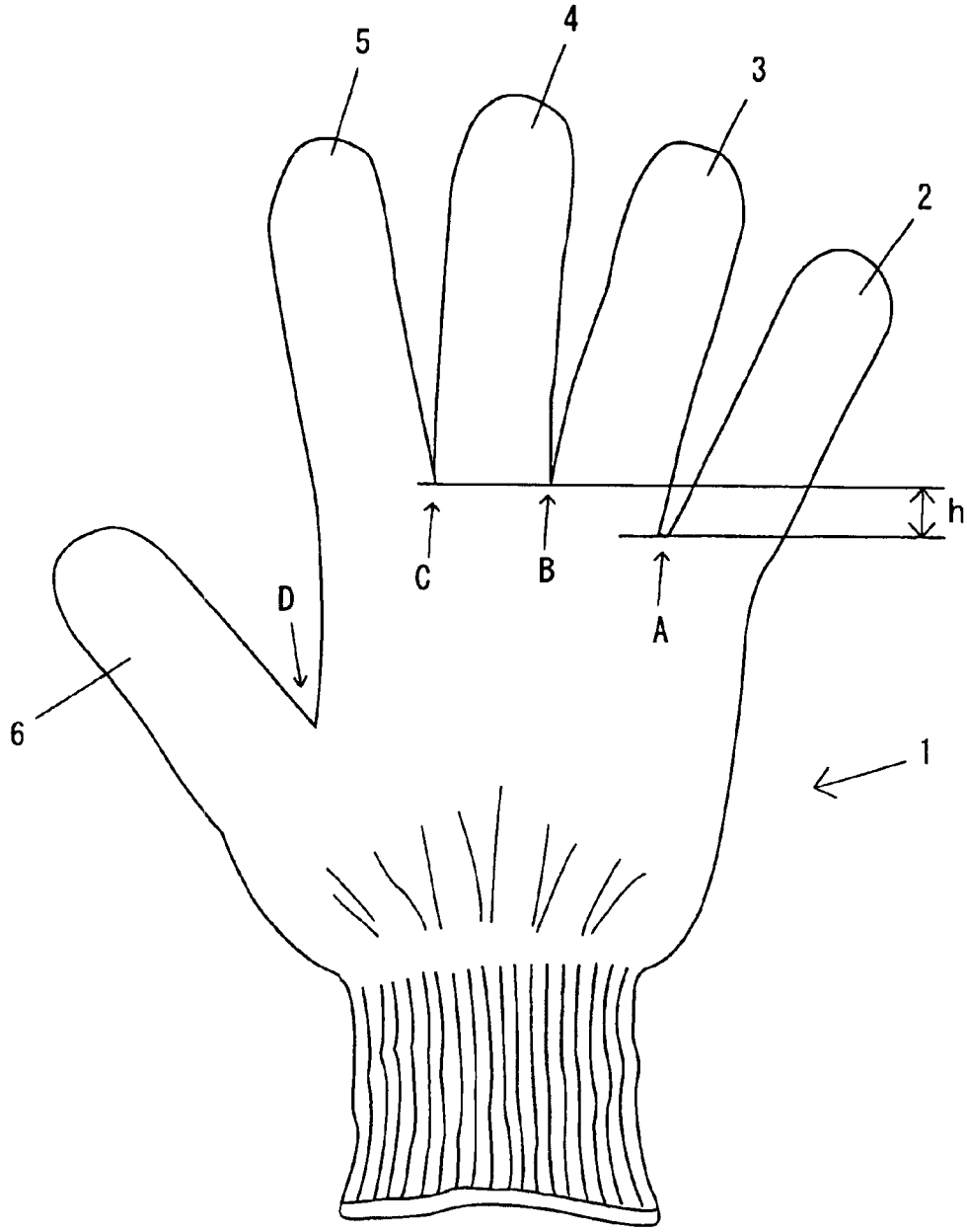
FIG. 1 is a view showing a knitted glove in an embodiment of the present invention.

Certain preferred embodiments according to a glove of the present invention will be described below with reference to the accompanying drawings. FIG. 1 shows a knitted glove knitted in the knitting method of the illustrated embodiment.

A knitted glove according to the illustrated embodiment can be knitted by using a full jacquard glove knitting machine having front and back needle beds mounting a number of needles thereon and being opposite to each other (available from Shima Seiki Mfg, Ltd. (Product name: SJF)). The illustration shows the knitted glove 1 having a crotch A between the fifth finger 2 and the fourth finger 3 which is positioned below a crotch B between the fourth finger 3 and the third finger 4 and a crotch C between the third finger 4 and the second finger 5 (to an extent corresponding to "h" in FIG. 1). Usually, the glove is knitted starting from the fifth finger and then the other fingers are knitted in the order of fourth finger, third finger, and second finger. Then, the part from the fifth finger to the second finger is knitted as a single tubular body to form a four-finger body. After the knitting of the four-finger body, a thumb is knitted and then the thumb and the four-finger body are knitted together to form a five-finger body. Thereafter, a wrist is knitted, with which the knitting of the glove is ended. In this knitting, when the crotches are knitted, the stitch holder is put into operation to overlap two adjacent fingers at end portions thereof on the sides on which they confront each other. In contrast to this, according to the embodiments of the present invention, a specific knitting way is adopted for the knitting of the crotch A between the fifth finger 2 and the fourth finger 3 without using the stitch holder, as mentioned later, which is to be noted, first. Second, the knitting that after the knitting of the individual parts from the fifth finger 2 to the second finger 5, the knitting that the fourth finger 3, the third finger 4 and the second finger 5 are knitted as a single tubular body to form a three-finger body 7 is inserted before the knitting of a four-finger body 8. The combination of the former knitting and the later knitting is different from the known glove knitting method. The concrete description on the way of knitting the already-known parts is omitted.

Figure 2:
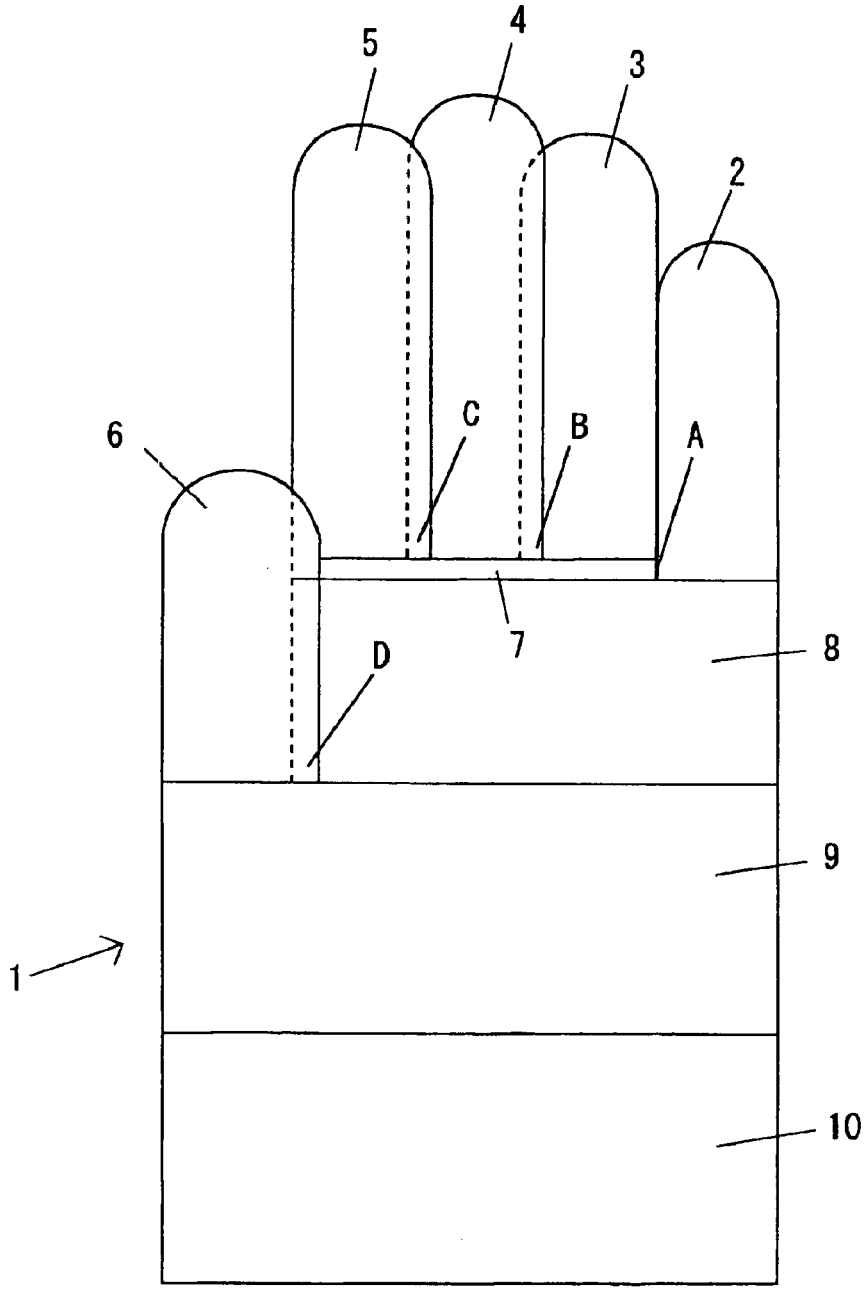
FIG. 2 is a schematic diagram illustrating the knitting of the glove shown in FIG. 1 with a glove knitting machine, indicating part names and active needle selection.

FIG. 2 illustrates an example of parts of the glove 1 of 10-gauge and medium size and the active needle selection. The fifth finger 2 is knitted with eleven needles in each needle bed (a total of twenty-two needles in both needle beds) and the fourth finger 3 is knitted with thirteen needles in each needle bed. The third finger 4 and the second finger 5 are knitted with fourteen needles, respectively, and the thumb 6 is knitted with fifteen needles. The crotch overlap stitches in the crotch B between the fourth finger 3 and the third finger 4, the crotch C between the third finger 4 and the second finger 5, and the crotch D between the four-finger body 8 and the thumb 6 are formed with three needles in each bed (a total of six needles in both needle beds), respectively. No crotch overlap stitch is formed in the crotch A between the fifth finger 2 and the fourth finger 3, and two needles for use in forming the gore are arranged in front and back.

(First Embodiment)

Figure 3:
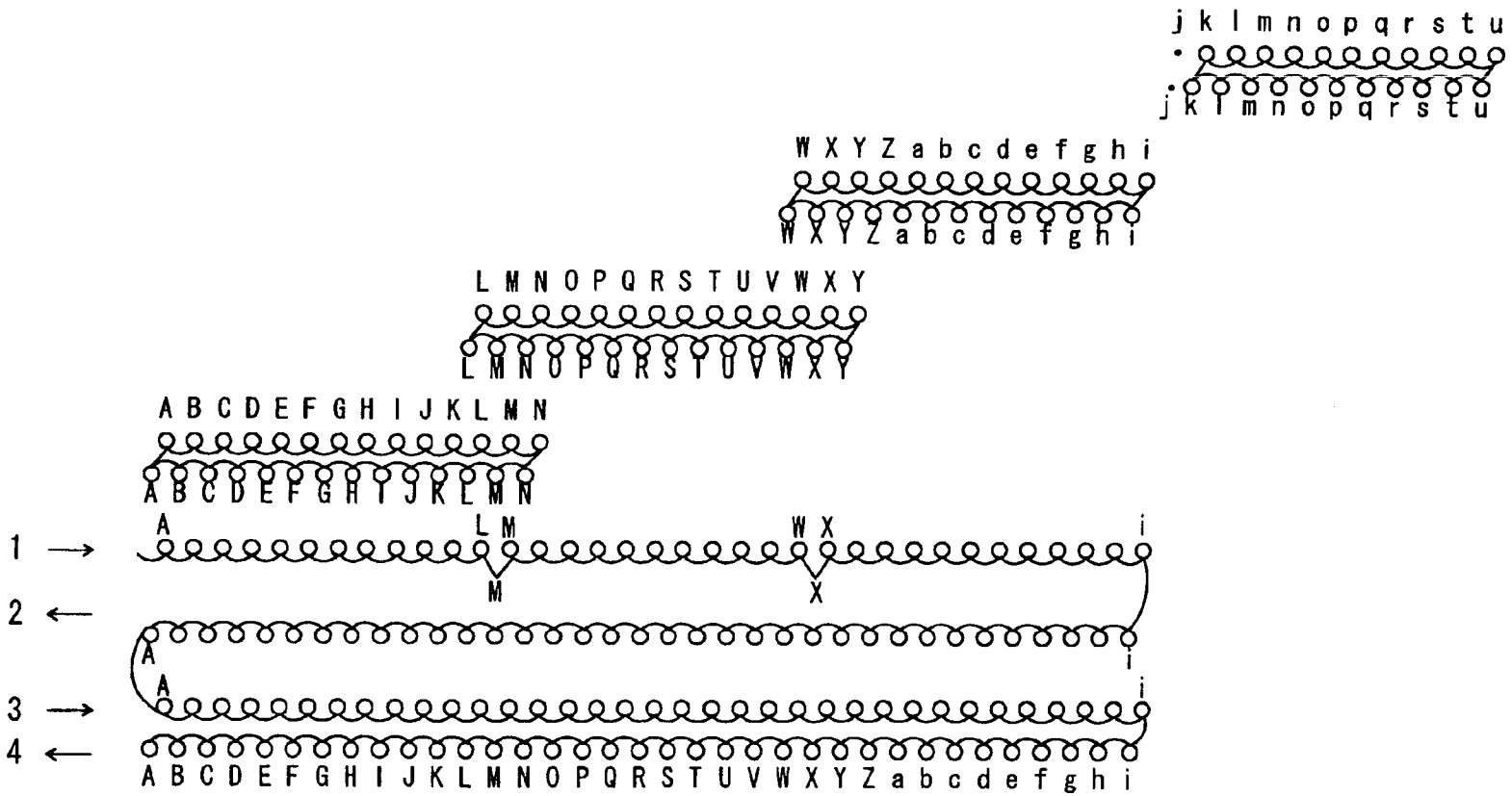
FIG. 3 is a view showing a first half of the knitting step of the glove according to the first embodiment.
Figure 4:
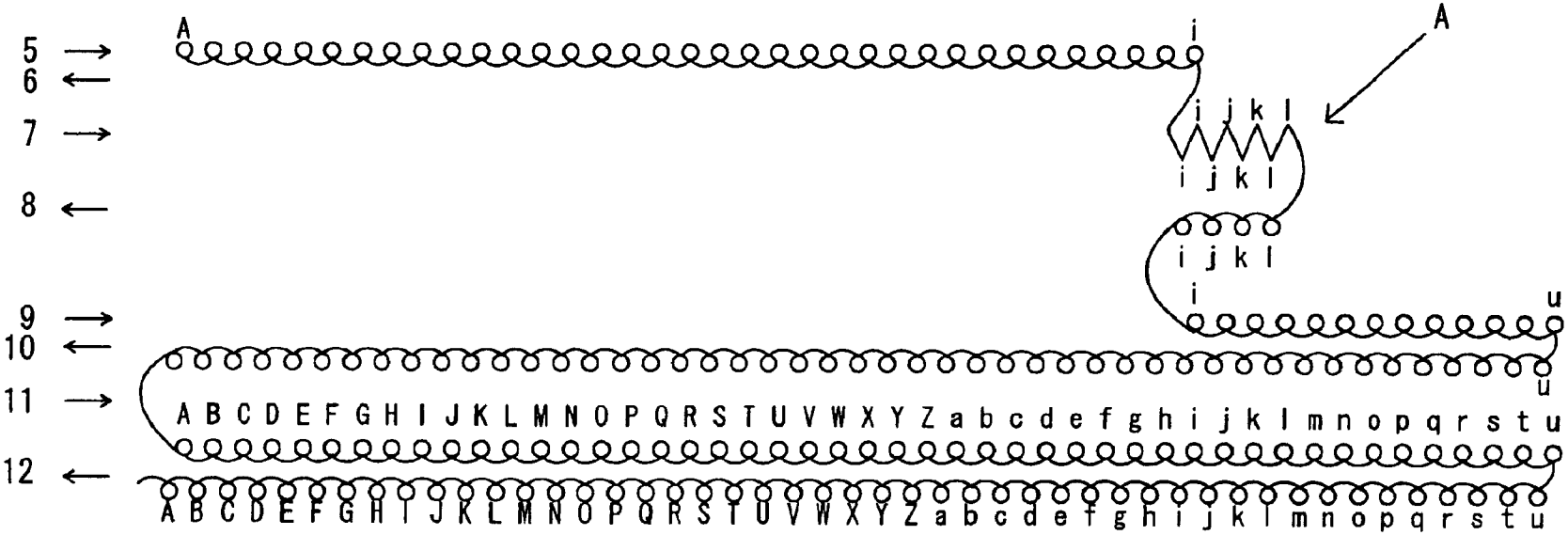
FIG. 4 is a view showing a second half of the knitting step of the glove according to the first embodiment.

FIGS. 3 and 4 are views showing the knitting courses to the four-finger body 8 of the glove 1 according to the first embodiment of the present invention. The fingers of the glove 1 are each knitted into a tubular form by circularly feeding a yarn to the needles of the front and back needles in the same manner as in the conventional knitting. First, the fifth finger 2 is knitted with the needles k–u. Then, the fourth finger 3 is knitted with the needles w–i, without using the needles j, j of the front and back beds corresponding in position to the crotch A. Then, the third finger 4 is knitted with the needles L–Y, and the second finger 5 is knitted with the needles A–N. In the illustrated embodiment, the knitting yarn is fed in the clockwise direction. When the knitting of the four fingers is completed, the empty needles j, j of the front and needle beds, one in each bed, are arranged between the fifth finger 2 and the fourth finger 3 and also the crotch overlap stitches are already formed in the crotch B between the fourth finger 3 and the third finger 4 and in the crotch C between the third finger 4 and the second finger 5.

In the steps 1–4, the three-finger body 7 is knitted, first. The three-finger body 7 is knitted two rounds with the needles A–i that were used in the knitting of the second finger 5, fourth finger 4 and third finger 3. In the step 1, the knitted loops are formed in the go-right knitting using the needles A–i of the back needle bed. In the step 8, the knitted loops are formed in the go-left knitting using the needles i–A of the front needle bed. During the knitting in the step 1, the knitted loops are tucked with the needles X, M of the front needle bed to join together the front and back knitted fabrics in the crotch C between the second finger 5 and the third finger 4 and in the crotch D between the third finger 4 and the fourth finger 3, respectively. In the steps 3, 4, the second round of the course knitting of the three-finger body 7 is performed with the needles A–i.

In the steps 5–9, the course knitting of the four-finger body 8 is performed by using the needles A–u, during which the knitting to form the gore and the knitting to close the crotch are performed. Specifically, in the step 5, the yarn feeder is shifted rightward to feed the yarn to the needles A-i of the back needle bed to form the knitted loops, first. Then, in the step 6, only the yarn feeder is reversed without feeding the yarn to any needle. In the step 7, the yarn feeder is shifted rightward again, to feed the yarn to the front and back needles i, i holding the knitted loops at the right end of the fourth finger 3, the empty needles j, j arranged between the fifth finger 2 and the fourth finger 3, and the needles k, k, l, l holding the knitted loops at the left end of the fifth finger 2, respectively. In the knitting in this step, a commonly called "stitch cam tuck" is produced wherein each needle that captures the yarn and draws it in is drawn in to a reduced extent to prevent an old loop held on the needle from being knocked over. This brings the needles j, j that were the empty needles into the yarn hooking state. In the next step 8, the yarn feeder is shifted leftward to feed the yarn to the needles l–i of the front needle bed so as to form the knitted loops. When the knitted loops are formed, the loops held on the needles i, k, l of the front needle bed are knocked over. In the step 9, the yarn is fed to the remaining needles i-u to form the knitted loops, with which the knitting of the first course of the four-finger body 8 is completed. In the steps 7 and 8 and the first half of the step 9, the knitting for forming the gore and closing the crotch is provided for the crotch A, to join together the fourth finger 3 and the fifth finger 2. Then, after the knitting of the step 10, the knitting in the steps 11 and 12 is repeated to form the four-finger body 8 having a desired length. Thereafter, the thumb 6, the five-finger body 9, and the wrist 10 are knitted in the same manner as in the conventional knitting, the description of which is omitted.

(Second Embodiment)

Figure 5:
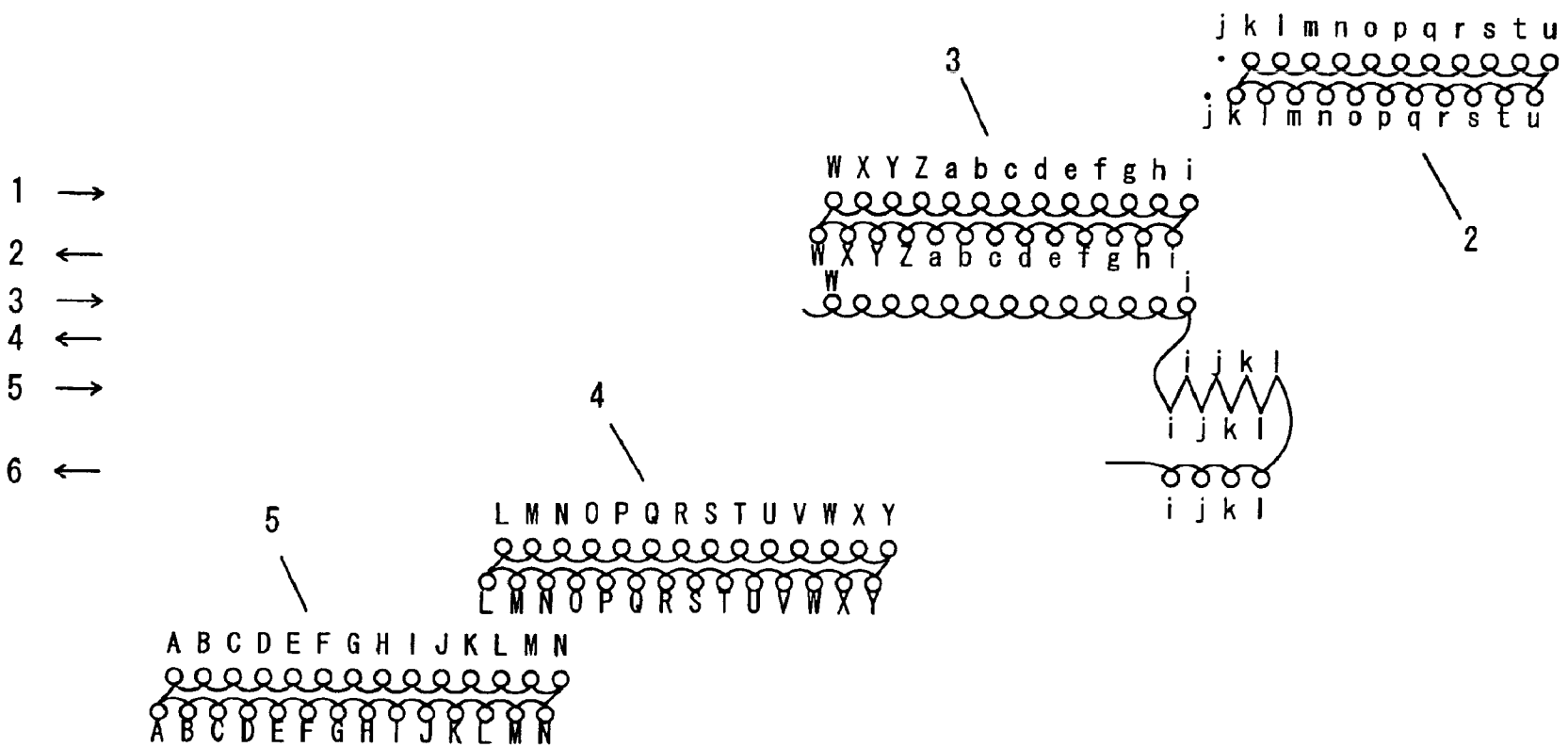
FIG. 5 is a view showing a first half of the knitting step of the glove according to the second embodiment.
Figure 6:
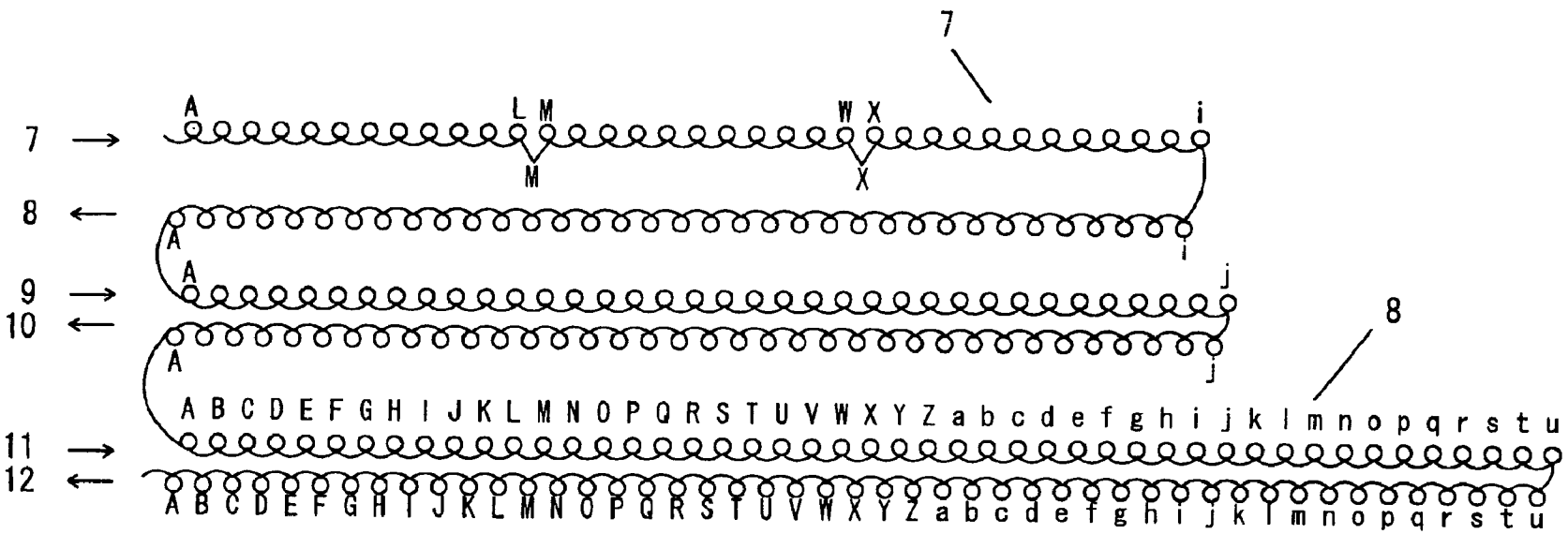
FIG. 6 is a view showing a second half of the knitting step of the glove according to the second embodiment.

FIGS. 5 and 6 are views showing the knitting course of the glove according to the second embodiment. Although the first embodiment wherein after the three-finger body 7 is knitted, the knitting of forming the gore and closing the crotch is provided for the crotch A during the knitting of the four-finger body 8 has been illustrated, reference is now made to the second embodiment wherein after the fourth finger 3 is knitted, the knitting of forming the gore and closing the crotch in the crotch A is performed before going to the knitting of the next third finger 4.

After the fifth finger 2 is knitted with the needles k–u, the fourth finger 3 is knitted into a tubular form by circularly feeding the yarn to the needles w–i of the front needle bed and the needles i–w of the back needle, both needles being for use in knitting the fourth finger 3, with the needles j, j skipped, in the clockwise direction, as shown in the steps 1 and 2. This knitting is repeated until the fourth finger 3 has a desired length. The step 3 is taken as the knitting of the final course of the fourth finger 3. In the step 3, the yarn feeder is shifted rightward to feed the yarn to the needles w–i of the back needle bed so as to form the knitted loops. The next steps 4–6 correspond to the steps 6–8 of the first embodiment. In the step 4, after the yarn feeder is reversed, the yarn feeder is shifted rightward again in the step 5, to feed the yarn to the front and back needles i, i holding the knitted loops at the right end of the fourth finger, the empty needles j, j arranged between the fifth finger 2 and the fourth finger 3, and the needles k, k, l, l holding the knitted loops at the left end of the fifth finger 2, respectively, so as to produce the stitch cam tuck. In the next step 6, the yarn feeder is shifted leftward to feed the yarn to the needles l–i of the front needle bed so as to form the knitted loops. When these knitted loops are formed, the loops held on the needles i, k, l of the front needle bed are knocked over. As a result of the knitting of these steps 5, 6, the knitting of forming the gore and closing the crotch is provided for the crotch A, to join together the fourth finger 3 and the fifth finger 2. After the knitting of the fourth finger 3 is completed in the step 6, a known knitting for disposing the edge yarn is performed with a looper cutting device (not shown). Sequentially, the third finger 4 is knitted with the needles L–Y of the front and back needle beds and then the second finger 5 is knitted with the needles A–N of the front and back needle beds.

Then, the knitting of the three-finger body 7 is performed after the second finger 5 is knitted. The three-finger body 7 is knitted by performing a two-round course knitting by using the front and back needles A–i for use in knitting of the second finger 5, third finger 4 and fourth finger 3. The steps 7, 8 illustrate the first round knitting. In the step 7, the knitted loops are formed in the go-right knitting using the needles A–i of the back needle bed. In the step 8, the knitted loops are formed in the go-left knitting using the needles i–A of the front needle bed. During the knitting in the step 7, the knitted loops are tucked with the needles M, X of the front needle bed to join together the front and back knitted fabrics in the crotch C between the second finger 5 and the third finger 4 and in the crotch D between the third finger 4 and the fourth finger 3, respectively. As illustrated in the steps 9, 10, in the second round knitting, the knitting is performed by feeding the yarn to the needle j as well which is arranged between the fifth finger 2 and the fourth finger 3, to form the gore. Although the second round of knitting of the three-finger body 7 may be knitted in the same manner as in the first round of knitting of the same, the crotch is further effectively prevented from being holed by feeding the yarn to the needle j as well, to form the knitted loops thereat.

In the illustration above, a full jacquard glove knitting machine is used as the knitting machine for knitting the glove. The full jacquard knitting machine is preferably used in that since any needle can be selected by a needle selection actuator, the knitted glove is not subjected to any design limitation. However, other knitting machines generally used as the glove knitting machine for knitting plain gloves such as working gloves may also be used. Take a glove knitting machine made by Shima Seiki Mfg, Ltd. (Product name: SFG) for example. It adopts a different needle selection system as a substitute for the needle selection actuator, according to which a number of cams are formed by pins inserted around an outside of a drum body and are made to slidably contact with control jacks of needle drive butts so that in response to rotation of the drum, protrusion of the butt from the needle bed can be varied to selectively vary the engagement between the butt and a carriage cam, so as to drive the needle selectively. This type of glove knitting machine may practically be used for knitting the glove of the invention by changing the positions of the pins inserted in the drum. It has an advantage that a relatively minor modification is simply required, particularly when the glove is knitted in the knitting step of the second embodiment.

In the glove 1 knitted in the knitting steps mentioned above, the crotch A between the fifth finger 2 and the fourth finger 3 is gored with the empty needles j, j arranged between the knitting needles of the front and back needle beds for knitting those fifth and fourth fingers and the fifth finger and the fourth finger are joined together by closing the crotch to each other through the gore sandwiched therebetween. Thus, since the stitches of the fifth finger 2 and the fourth finger 3 at the ends thereof on the side on which they confront each other are not directly overlapped with each other in the crotch A, the strain applied to the crotch A when wearing the glove 1 is loosened by the gore. This permits one's fifth finger to be inserted deep in the fifth finger of the glove. Particularly, as a result of two rounds of knitting being provided for the three-finger body 7, the crotch A is positioned further below the other crotches in the three-finger body 7 to that extent, thus providing a further improved fittedness. Further, since the crotch A is closed in the knitting way mentioned above, the crotch A can be prevented from being holed. The gloves thus formed can be used as a variety of gloves, including fashion glove and working glove. Particularly when this glove is used as a prototype of a coated glove, the glove can be coated, with its fifth finger fitted deep into a corresponding crotch of a glove pattern. Accordingly, the finished coated glove is comfortably fitted in one's hand so that work can be done easily with a gloved finger. Also, the crotches are closed in the knitting to prevent them from being holed, so that when the glove is coated with liquid, the glove is protected from penetration of the liquid into the glove from the crotches.

Figure 7:
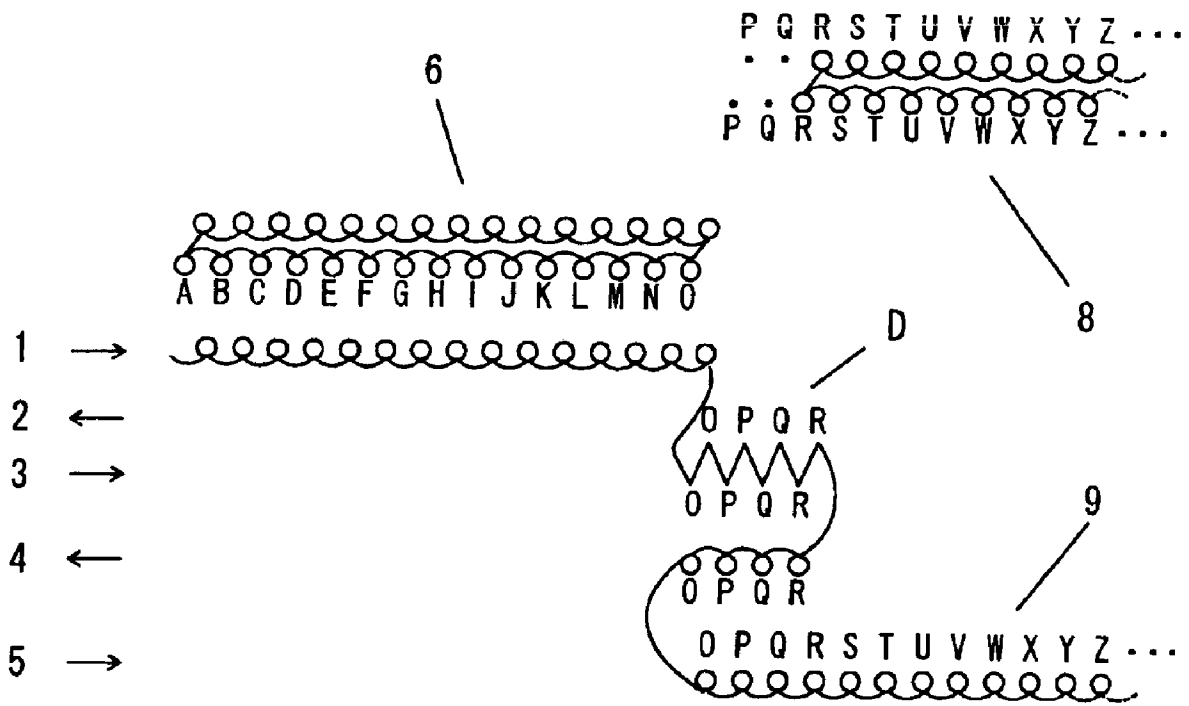
FIG. 7 is a step diagram showing the knitting for forming a gore and closing a crotch in the finger crotch D between the thumb and the four-finger body.
Figure 8:
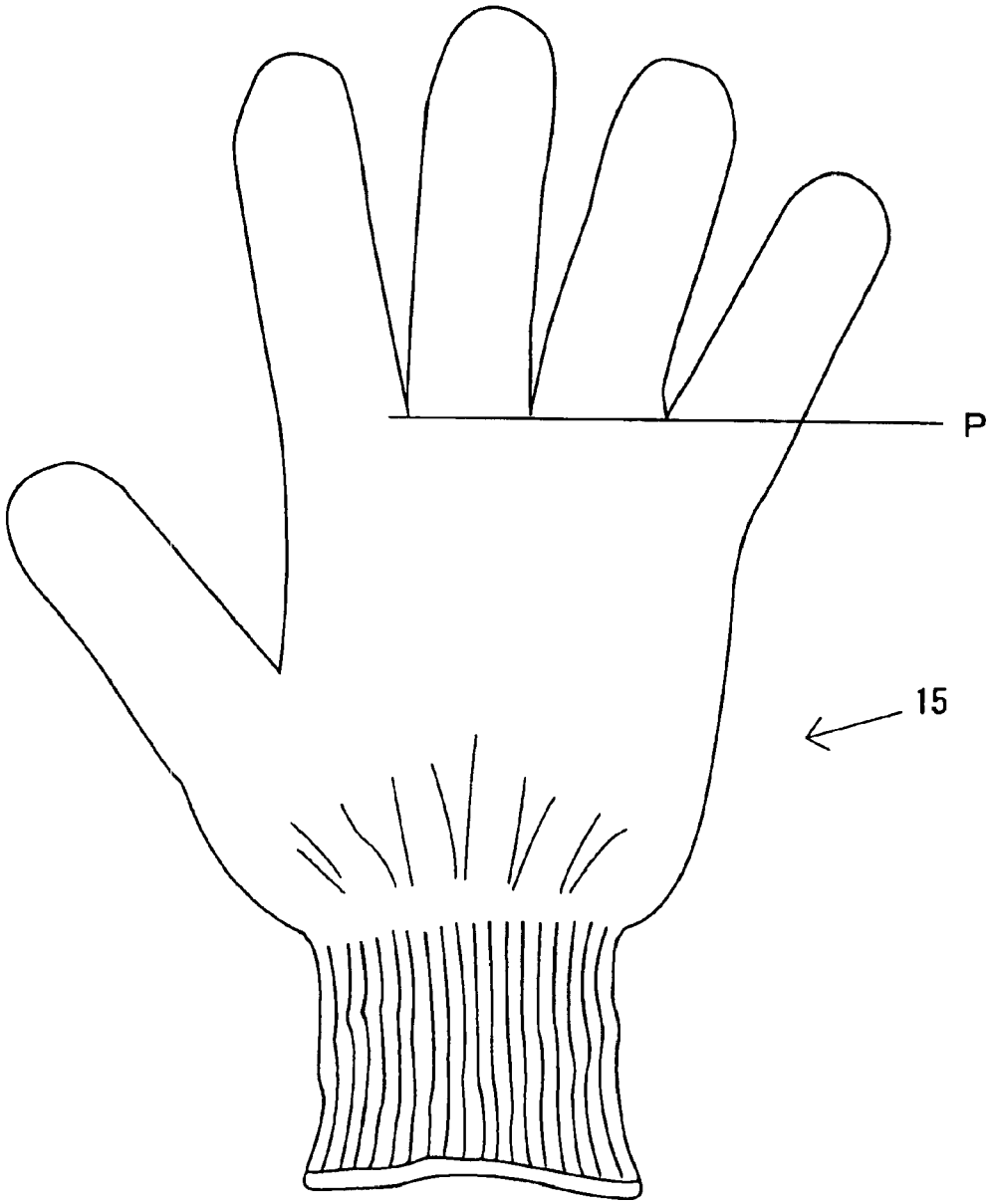
FIG. 8 is a view showing a conventional glove.

Although the application of the invention to the glove with five fingers has been described in the illustration above, the present invention is applicable to the crotch between the thumb and the four-finger body of the glove. FIG. 7 is a step diagram showing the knitting for forming the gore and closing the crotch in the finger crotch D between the thumb 6 and the four-finger body 8. In this case, the crotch D is knitted in the same knitting way as the crotch between the fifth finger 2 and the fourth finger 3 of the first embodiment 1 mentioned above, except a total of four empty needles P, Q of the front and back needle beds being used. The steps 1–5 of FIG. 7 correspond to the steps 5–9 of FIG. 4, but differ therefrom in that the first course of the five-finger body 9 is knitted in the steps 1–5, during which the knitting to form the gore in the crotch D and the knitting to close the crotch are performed. In this embodiment, since the crotch is gored with the needles P, Q, additional room is formed in the crotch at the thumb, so that when wearing the glove, a wearer does not feel uncomfortable tightness at his/her thumb. The knitting of the present invention is applicable not only to a glove with five fingers but also to a mitten which is a glove with two sections, one for the thumb and the other for all four fingers. Also, the number of empty needles used for forming the gore may be increased to three or more. Although the three-finger body is incorporated in the knitting in the embodiments illustrated above, the knitting of the three-finger body is not indispensable. Illustrated above is an example of a 10-gauge glove. When the three-finger body is incorporated in the knitting, the number of rounds of the knitting may be varied in accordance with the gauge.

Capabilities of Exploitation in Industry

In the glove knitted in the manner described above, a crotch is gored with the empty needles of the front and back needle beds arranged between the knitting needles for knitting the fingers of the glove, so that the adjacent fingers are joined to each other through the gore sandwiched therebetween by closing the crotch. Thus, since the stitches of the adjacent fingers at the ends thereof on the side on which they confront each other are not directly overlapped with each other in the crotch, the strain applied to the crotch when wearing the glove is loosened by the gore, thus providing an improved fittedness. Also, since the crotch is closed by the knitting mentioned above, the crotch is prevented from being holed. In the glove knitted by applying the invention to the crotch between the fifth finger and the fourth finger, the strain applied to the crotch is suppressed, thus permitting one's fifth finger to be fitted deep into the fifth finger of the glove. In the glove incorporating the knitting of the three-finger body, the crotch between the fifth finger and the fourth finger is positioned further below the other crotches in the three-finger body to that extent, thus providing a further improved fittedness. In the glove knitted by applying the invention to the crotch between the thumb and the four-finger body, little strain is generated in the crotch between the thumb and the four-finger body, so that when wearing the glove, a wearer does not feel uncomfortable tightness at his/her thumb and does not feel uncomfortable even in long hours of wearing.

What is claimed is:

1. A knitted glove having at least one finger crotch and knitted from a fingertip toward a palm by using a flat knitting machine having front and back needle beds mounting a number of knitting needles thereon and arranged to be opposite to each other, wherein with at least one empty needle arranged between the knitting needles for use in knitting one of two adjacent fingers confronting each other across the finger crotch therebetween into a tubular form and the knitting needles for use in knitting the other of the two adjacent fingers confronting each other across the finger crotch therebetween, into a tubular form, at least one for each needle bed, a knitting yarn is fed to the knitting needles for use in knitting the one finger, to knit the one finger into a tubular form and then is fed to the knitting needles for use in knitting the other finger, to knit the other finger into a tubular form and, thereafter, the knitting yarn is fed to the knitting needles adjacent to the finger crotch and to the empty needles arranged between the two adjacent fingers, out of the knitting needles on the front and back needle beds for knitting the respective fingers, to form stitches at those needles in the following steps, whereby the two adjacent fingers at the at least one finger crotch are closed at ends thereof on the side on which they confront each other and also are gored, a. the step of shifting a yarn feeder toward the finger crotch to feed the knitting yarn to the knitting needles for use in knitting the one finger mounted on one of the front and back needle beds, to form knitted loops of the one finger;

b. the step of reversing a traveling direction of the yarn feeder at the finger crotch;

c. the step of shifting the yarn feeder toward the finger crotch again, to feed the yarn to the empty needles arranged between the knitting needles on the front and back needle beds holding loops of the one finger at a side end thereof and the other finger and to the knitting needles on the front and back needle beds holding loons of the other finger at a side end thereof, so as to out the knitting needles holding the loops of the fingers at the side ends thereof into a state in which the knitting yarn is drawn in to a reduced extent to prevent an old loop held on the needle from being knocked over, and put the empty needles into a yarn hooking state; and d. the step of reversing the traveling direction of the yarn feeder to feed the yarn to the knitting needles of the other needle bed for knitting the one finger, so as to form the knitted loops of the one finger.

2. The knitted glove according to claim 1, which is knitted starting from a fifth finger and then is knitted in the order of fourth finger, third finger, and second finger, to knit the four fingers and, thereafter, a four finger body is knitted and then a thumb is knitted, followed by the knitting of a five-finger body, and wherein said knitting for the crotch is provided for the finger crotch between the fifth finger and the fourth finger.

3. The knitted glove according to claim 2, wherein the knitting of a three-finger body is inserted before the knitting of the four-finger body.

4. The knitted glove according to claim 2, wherein the knitting of the finger crotch is performed before the knitting of the three-finger body.

5. The knitted glove according to claim 3, wherein the knitting of the finger crotch is performed after the knitting of the three-finger body.

6. The knitted glove according to claim 1, which is knitted starting from a fifth finger and then is knitted in the order of fourth finger, third finger, and second finger to knit the four fingers and, thereafter, a four-finger body is knitted and then the thumb is knitted, followed by the knitting of a five finger body, and wherein said knitting for the crotch is provided for the finger crotch between the thumb and the four finger body.

7. The knitted glove according to claim 6, which is a mitten and wherein said knitting for the crotch is provided for the finger crotch between the thumb and the four finger body.

* * * * *